US006063107A

United States Patent [19]

Wexler

[11] Patent Number: 6,063,107

[45] Date of Patent: May 16, 2000

[54] BABY TOY

[76] Inventor: Toby J. Wexler, 303 Paddington, Lafayette, La. 70508

[21] Appl. No.: 09/248,242

[22] Filed: Feb. 10, 1999

[51] Int. Cl.[7] ..... A61J 17/00

[52] U.S. Cl. ..... 606/234

[58] Field of Search ..... 606/234, 235, 606/236; D24/194–198; 215/11.1–11.6; 446/419, 437; 273/58

[56] References Cited

U.S. PATENT DOCUMENTS

| | | | |
|---|---|---|---|
| D. 279,218 | 6/1985 | Carpel . | |
| 2,699,785 | 1/1955 | Allen | 606/236 |
| 4,195,638 | 4/1980 | Duckstein | 606/234 |
| 5,292,336 | 3/1994 | Spence, Jr. et al. . | |
| 5,843,128 | 12/1998 | Wexler . | |

*Primary Examiner*—Michael Buiz
*Assistant Examiner*—Vikki Trinh
*Attorney, Agent, or Firm*—Robert N. Montgomery

[57] ABSTRACT

A plural nipple baby toy including a polymeric, hollow spherical ball constructed with interlocking hemispheres having a plurality of holes in its periphery surface adapted for receiving a plurality of brightly colored bottle or pacifier nipples. The nipples are installed within the ball prior to assembly of the interlocking hemispheres and secured therein by retainers in a manner whereby the ball and nipple are permanently fixed as an integral unit. The nipples may be symmetrically spaced with the preferred embodiment having up to six nipples. The toy can be transformed into a plural nipple ball with a handle by substituting a handle assembly for one of the nipples. A more elaborate toy may be assembled by simply providing two plural nipple balls connected by a common handle assembly replacing one nipple on each ball. In any case, each spherical ball having a plurality of conventional bottle nipples, each located in a manner which allows the child to suck on the nipples without interference from the adjacent nipple, the child can easily find and grasp the pacifier/toy and insert one of the nipples in his mouth without manipulating the pacifier. The pacifier is sufficiently large that it cannot be easily lost, is brightly colored, and is immensely pleasurable to an infant or toddler.

11 Claims, 5 Drawing Sheets

BABY TOY

BACKGROUND OF THE INVENTION

1. Field of the Invention

This invention relates generally to baby toys and more particularly to a toy with a plurality of suckable bottle or pacifier nipples.

2. General Background

Pacifiers have been designed for infants as a substitute for bottle nipples for many years. Such apparatus take many shapes, but most utilize the basic, commonly used, mouth shield and nipple arrangement; however, some provide a handle portion which is generally integral with the pacifier, while some provide a ring handle as seen in U.S. Pat. No. 5,292,336. Although it is desirable for a pacifier to have a handle so that the child or an adult can hold the pacifier, care must be taken so that the handle does not become a danger to the child.

Plural nipple pacifiers have been designed, such as that disclosed in U.S. Des. Pat. No. 279,218 which provides a variety of odd shaped nipples clustered around a central core and further having a pair of rings made of a dissimilar material which may be dislodged or removed. By necessity, this pacifier would be made in one piece and of solid construction and, therefore, quite heavy. This pacifier is unattractive and cumbersome, offers no explanation of its construction material, which could be tough or hard, and provides no restraint with regard as to how much of the nipple can be placed in the child's mouth, thereby possibly causing suffocation. Further, this configuration could cause harm to a child's eye due to the angle of the protrusions and there is no way for the child to grasp and position the pacifier.

Due to the child's lack of coordination, it is often difficult for the child to manipulate the pacifier by the handle portion, where one exists, and thereby place the nipple portion in its mouth. The mouth shields of most safe pacifiers are generally made of hard plastic, rubber or urethane and are, therefore, potentially hazardous should the child fall. However, such shields are considered necessary to prevent suffocation. The hard plastic shields are certainly uncomfortable if the child should fall asleep on the pacifier. Therefore, in my previous U.S. Pat. No. 5,843,128 I disclosed a hollow, one piece, pliable pacifier having two ball portions connected by an integral handle or grasping portion, each ball portion having multiple nipples, thereby presenting an array of nipples to the child's mouth without manipulation. It is now realized that an improvement is needed which allows the nipples to be separately constructed from a more resilient material having multiple colors and further provide a manufacturing design having the ability to transform the toy from one embodiment to another.

SUMMARY OF THE INVENTION

The instant invention addresses the improvement associated with pacifiers as discussed above in a unique manner. First, a hollow polymeric spherical ball is provided, constructed with interlocking hemispheres having a plurality of holes in its periphery surface adapted for receiving a plurality of brightly colored bottle or pacifier nipples. The nipples are installed within the ball prior to assembly of the interlocking hemispheres and secured therein by retainers in a manner whereby the ball and nipple are permanently fixed as an integral unit. The nipples may be symmetrically spaced with the preferred embodiment having up to six nipples. The toy can be transformed into a plural nipple ball with a handle by substituting a handle assembly for one of the nipples. A more elaborate toy may be assembled by simply providing two plural nipple balls connected by a common handle assembly replacing one nipple on each ball.

In any case, with each ball having a plurality of conventional bottle nipples, each located in a manner which allows the child to suck on the nipples without interference from the adjacent nipple, the child can easily find and grasp the pacifier/toy and insert one of the nipples in his mouth without manipulating the pacifier. The pacifier is large enough that it cannot be easily lost, is brightly colored, and is immensely pleasurable to an infant or toddler.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
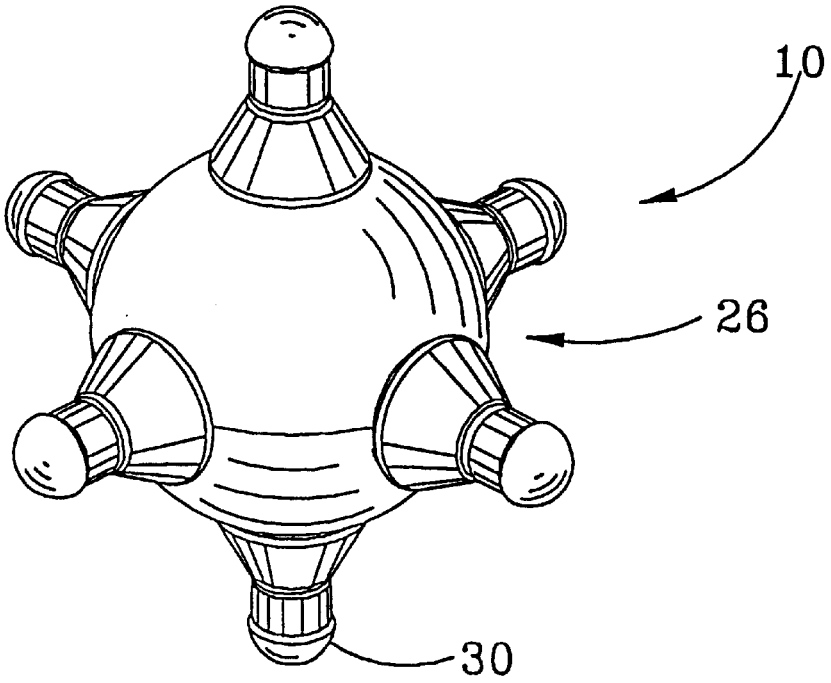
FIG. 1 is an isometric view of the basic embodiment of the toy.
Figure 5:
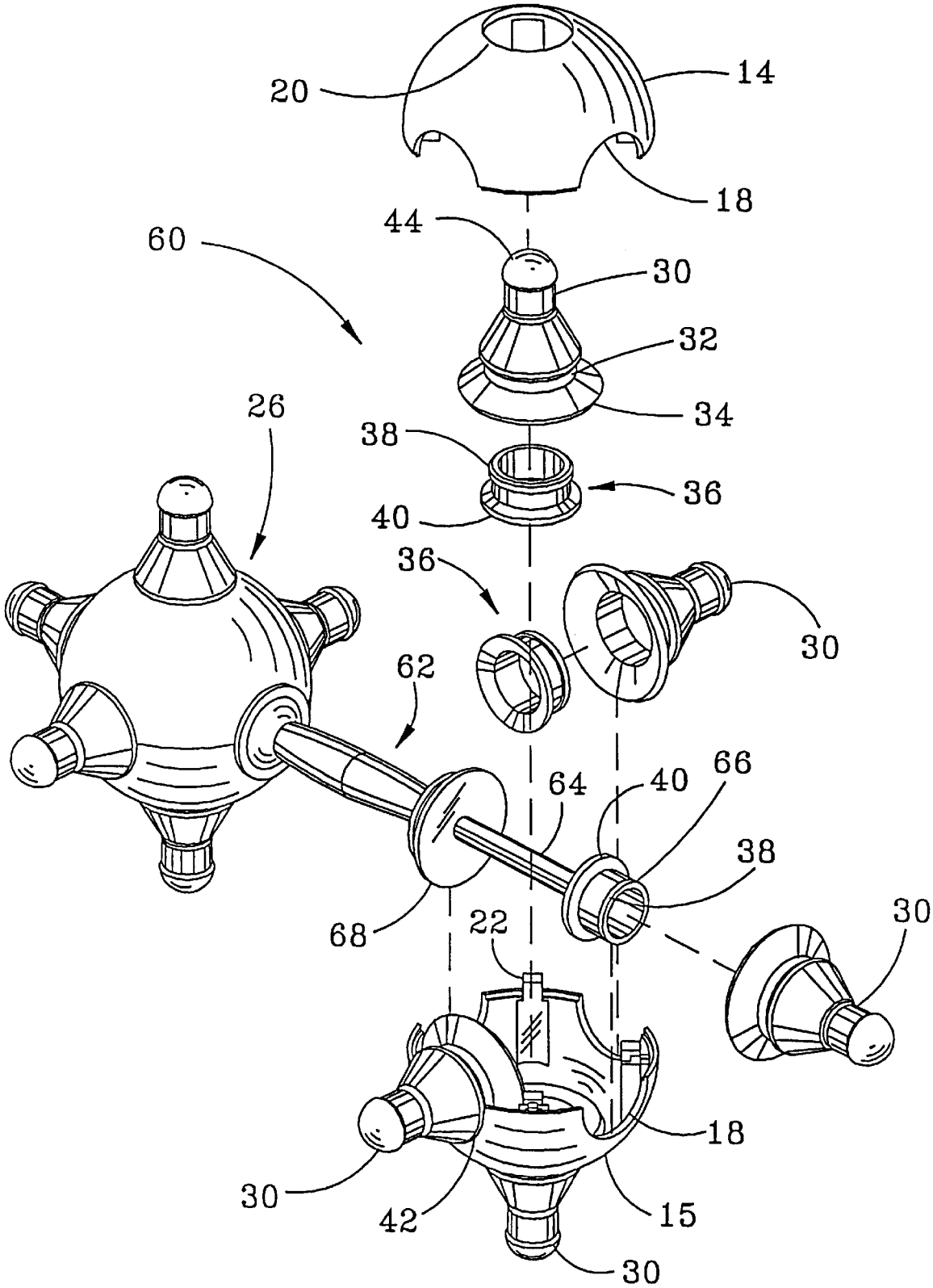
FIG. 5 is an exploded isometric view of a portion of the third embodiment illustrated in FIG. 3.
Figure 6:
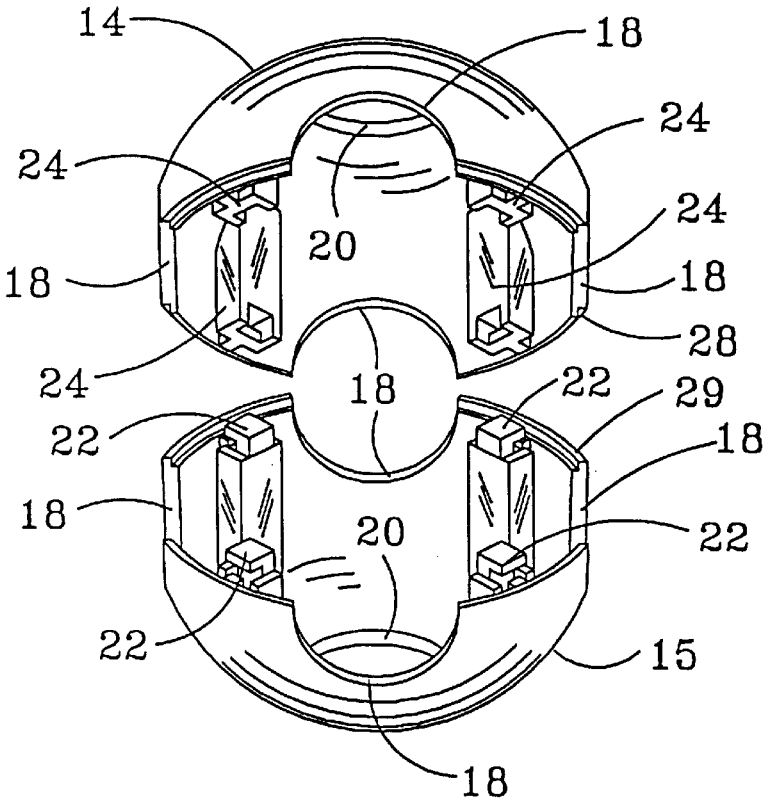
FIG. 6 is an inside isometric view of the upper and lower hemispherical portions illustrated in FIG. 5.

FIG. 1 illustrates the basic plural nipple toy 10 as disclosed herein. The ball or spherical portion 26 being composed of upper and lower hemispheres 14,15 equally divided in a manner whereby the parting line 16 passes through four holes equally spaced around the periphery, thus producing four half circles 18 in each of the hemispherical portions as illustrated in FIG. 5. A hole 18 is also provided in the polar region of each of the hemispheres 14,15 placed an equal distance from the four half circles 18. As seen in FIG. 6 one of the hollow hemispheres 15 contains four internal locking probes 22 integrally molded therein. The opposite or upper hemisphere 14 contains four corresponding receiving members 24 for receiving and permanently mating with the locking probes 22 and securing the upper and lower hemispheres 14,15 together as seen in FIG. 1, thus forming a sphere 26 of approximately 2 inches in diameter, having a plurality of holes 18,20. The upper hemisphere 14 and the lower hemisphere are held in concentric alignment by cooperative offset lips 28,29 formed along the leading edges of each hemisphere 14,15.

Figure 8:
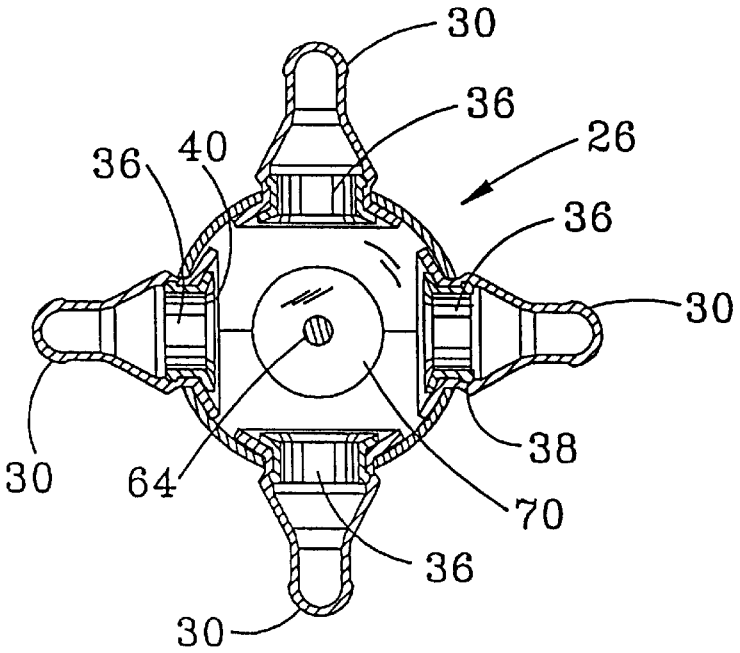
FIG. 8 is a cross section view of the embodiment illustrated in FIG. 4 taken along sight lines 8—8.
Figure 9:
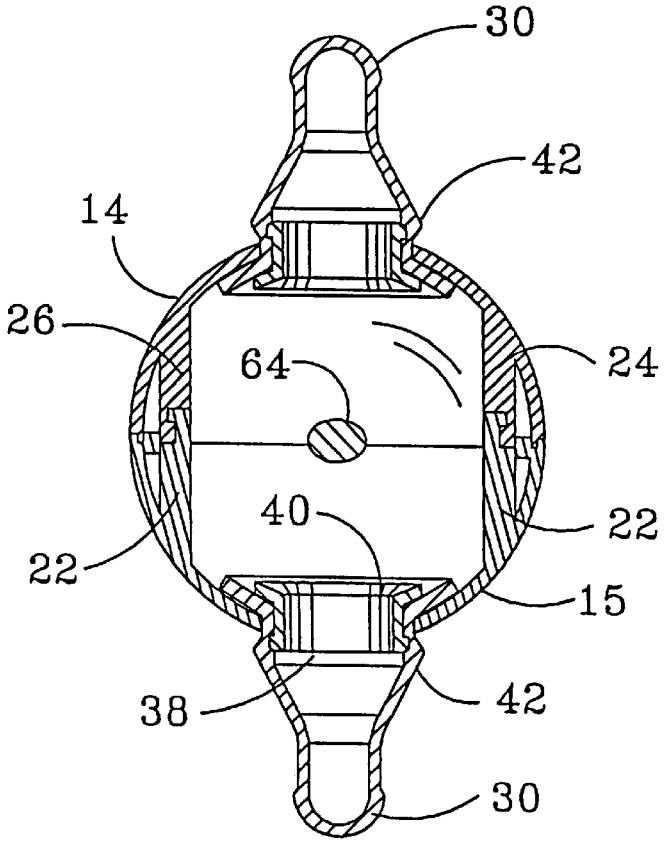
FIG. 9 is a cross section view of the embodiment illustrated in FIG. 4 taken along sight lines 9—9.

Although it is preferred that the holes formed by the half circles 18 be located on the parting or separation line of the hemispheres 14,15 and that the holes 20 be located in the polar cap of each hemisphere, it is clearly anticipated that the holes can be just as easily be located in a manner whereby the parting line 16 does not intersect the holes formed by the half circles 18 and the hole 20 located offset from the polar cap, thus having three complete holes in each hemisphere, in which case the nipples 30 shown in FIG. 1 need not be located at right angles to each other as illustrated. Prior to assembly of the two hemispheres, as seen in FIG. 5, the nipples 30, being preferably of different bright colors, are positioned within each of the half circles 18 in a manner whereby the groove 32 in the nipple 30 corresponds to the half circle 18 dimension, thus capturing the flange portion 34 of the nipple within the hemisphere 15. A nipple 30 is also pressed into position with hole 20 by deformation of the nipple. As seen in FIG. 8, each nipple is held in position by a retainer 36 having an external lip 38 and a flange 40, the lip 38 and the flange 40 having a larger diameter than that of the half circle 18. The retainer member 36 is inserted within the nipple 30 prior to positioning the nipple within the confines of the half circle 18. Therefore, when the upper hemisphere 14 engages the lower hemisphere 15, as seen in FIG. 9, the nipple flange 34 and the retainer 36 are securely locked within the formed hollow ball 26.

Since the retainer 36 is a polymeric more rigid than the nipple 30, the lip 38 prevents the nipple from being deformed and extracted from or forced into the hemispherical ball 26. The retainer 36 and the hemispherical members 14,15, are flexible enough to allow it and the nipple 30 to be extruded by force into the polar hole 20 in each hemisphere. However, once the nipple 30 and retainer 36 are in position, it is very difficult to force the nipple back into the ball 26 due to the configuration of the nipple shoulder 42 and the retainer lip 38 as seen in FIG. 9. The tip 44 of each nipple 30 may be of any configuration which may be considered appropriate for a child to suck on. The nipple material may be of any type polymer approved for sanitary use by a child.

Figure 2:
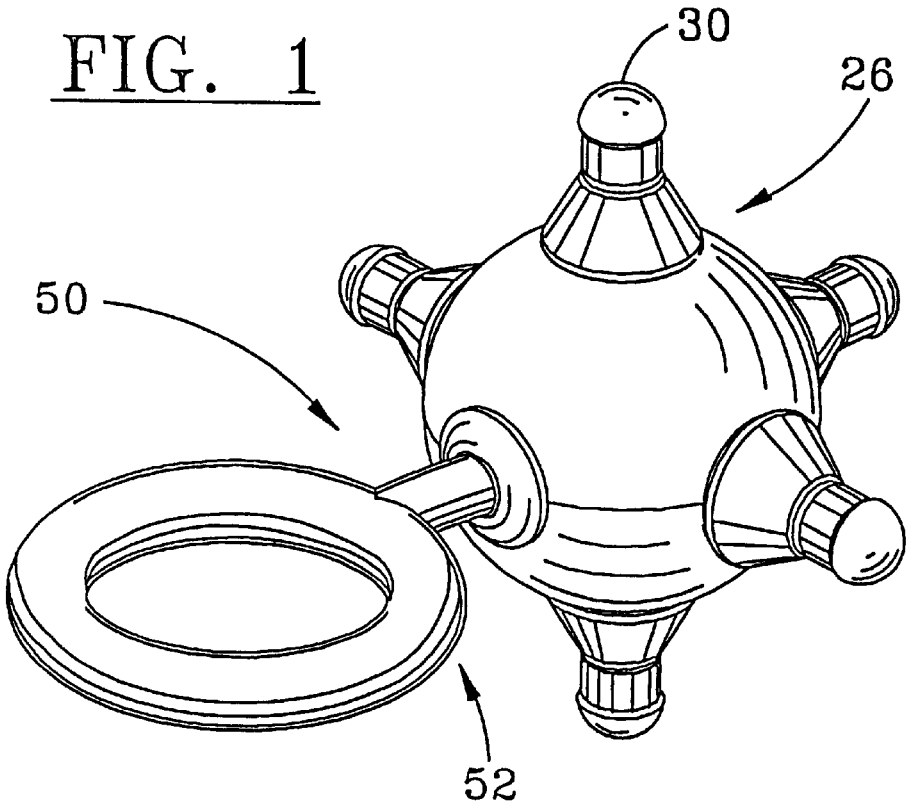
FIG. 2 is an isometric view of a second embodiment utilizing the basic embodiment in FIG. 1.
Figure 3:
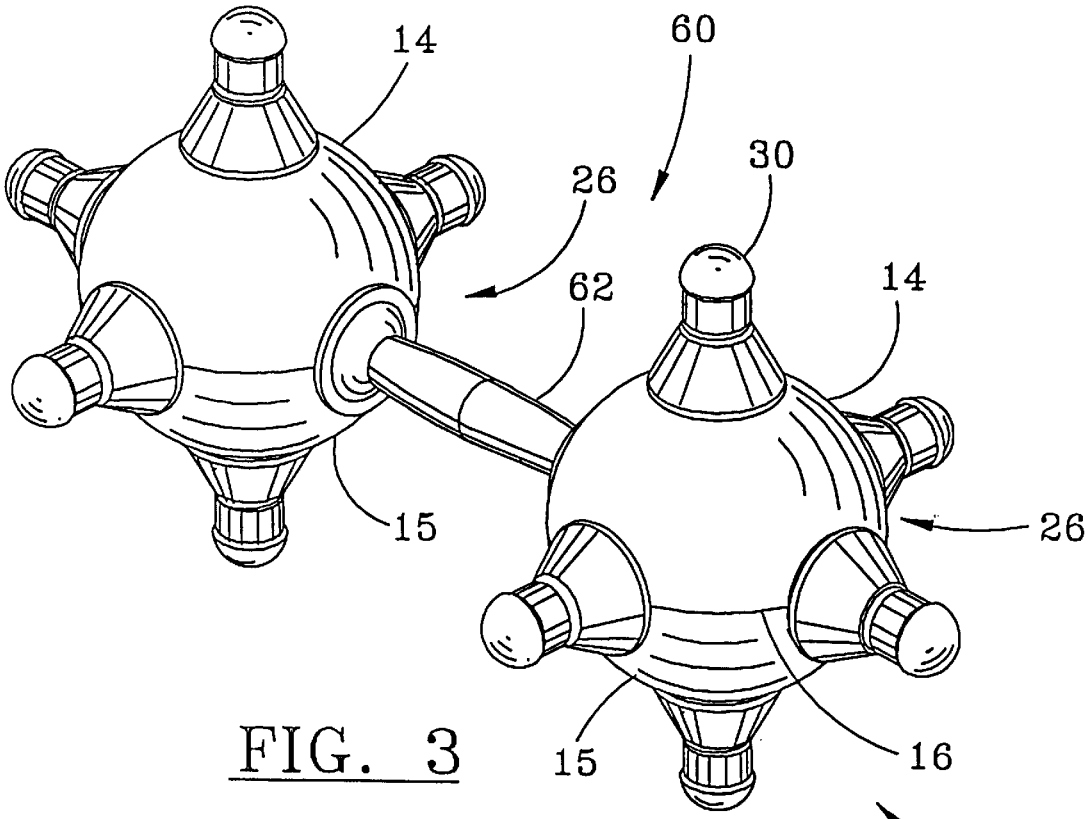
FIG. 3 is an isometric view of a third embodiment utilizing the basic embodiment as illustrated in FIG. 1.
Figure 4:
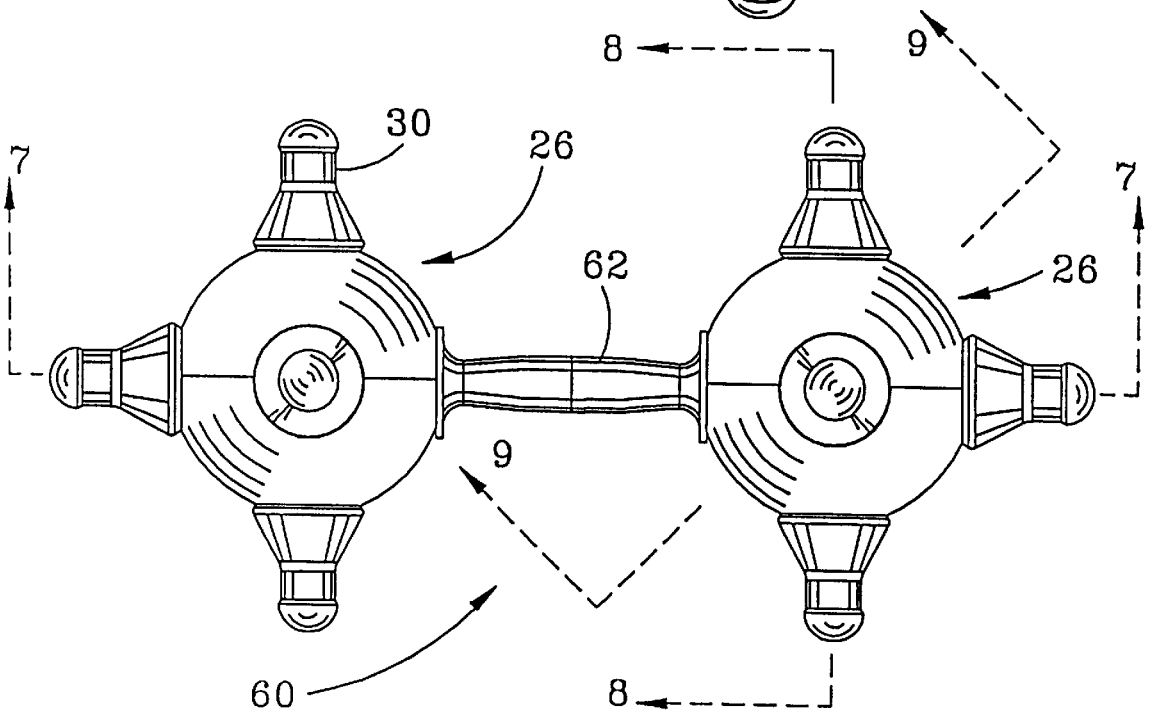
FIG. 4 is a front elevation view of the third embodiment illustrated in FIG. 3.
Figure 7:
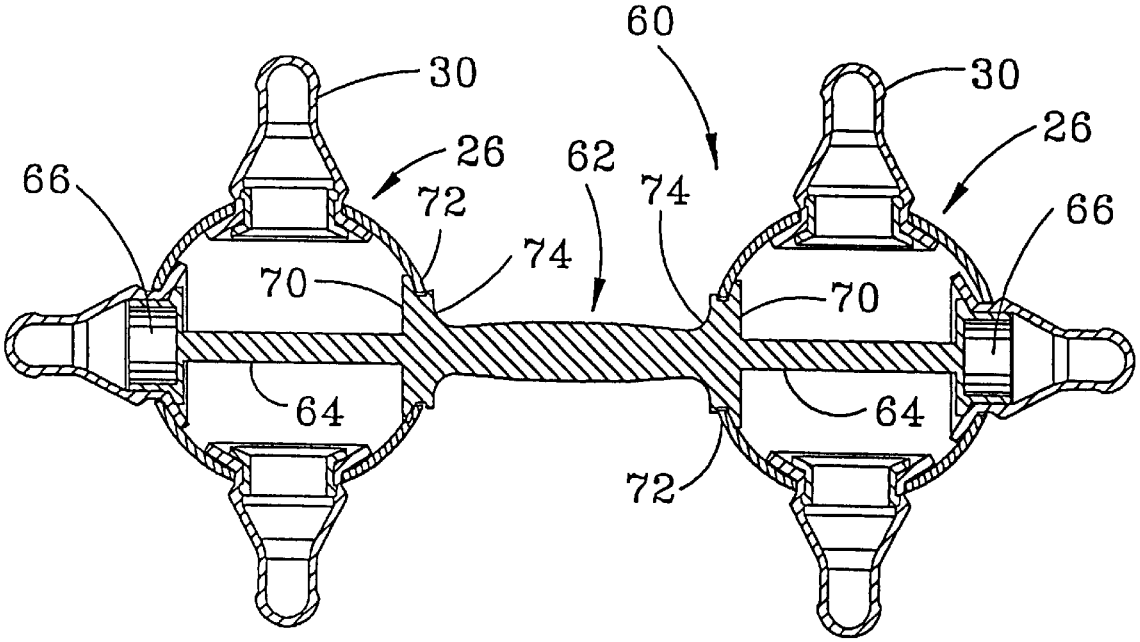
FIG. 7 is a cross section view of the embodiment illustrated in FIG. 4 taken along sight lines 7—7.

The second embodiment 50, illustrated in FIG. 2, utilizes the basic ball concept arrangement and construction illustrated in FIG. 1 and described above with the exception that one of the nipples is removed and replaced with a handle assembly 52 adapted to be captured in a similar manner as the handle 62 illustrated in FIG. 5. The third embodiment 60 illustrated in FIG. 3 is a double ball arrangement in which a pair of hollow spherical ball assemblies 26 having plural nipples are joined by a common handle 62. The handle is adapted to the balls by a stem portion 64 having a retainer 66 having a lip 38 and flange 40 and an adapter retainer 68. The adapter retainer 68, better seen in FIG. 7, having a flange 70, a groove 72 dimensioned consistent with hole 18 and a lip 74. The handle assemblies 52 and 62 provide both strength with the use of the stem 64 and retainment for at least one of the nipples 30. The handles 52 and 62 may also be provided with a soft polycoating to provide a gripping surface.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A nipple toy comprising:

a) a hollow spherical body comprising an upper hemispherical member, a lower hemispherical member, and a means for mechanically locking said upper and lower hemispherical members one to the other to form said spherical body each said hemisphere having at least one diametrical nipple opening and a plurality of semicircular nipple openings;

b) a plurality of hollow pliable nipples protruding from said nipple openings in said spherical body; and c) a means partially inserted into said nipples located within said spherical body for retaining said nipples securely to said spherical body.

2. The nipple toy according to claim 1 wherein said means for mechanically locking said upper and lower hemispherical members one to the other further comprises internal locking probes attached within said lower hemispherical member and corresponding receiving members attached within said upper hemispherical member for receiving and permanently mating with said locking probes.

3. The nipple toy according to claim 1 wherein the means for retaining said nipples to said spherical body is a polymeric member having a rigidity factor greater than that of said nipples and comprising a lip and flange portion forming a groove therebetween.

4. The nipple toy comprising:

a) a hollow spherical body having a plurality of nipple openings therein and further comprising upper and lower hemispherical members having means for mechanically attaching said hemispherical members together;

b) a plurality of hollow, pliable nipples protruding outwardly from said openings in said spherical body; and c) a means for retaining said nipples securely to said spherical body.

5. The nipple toy according to claim 4 wherein at least one said nipple openings in said spherical body is fitted with a handle assembly.

6. The nipple toy according to claim 5 wherein said handle assembly comprises a ring member.

7. The nipple toy according to claim 5 wherein said handle assembly comprises:

a) a tubular stem portion rigidly attached and extending from said ring member;

b) a means for retaining at least one said nipple located at an end of said stem portion; and c) a collar comprising an adapter flange and lip portions fixed to said stem portion intermediate said means for retaining and said ring member.

8. The nipple toy according to claim 5 wherein said handle assembly comprises an elongated grasping portion, an adapter flange having a lip portion located at each end of said grasping portion, an elongated stem portion, extending from each said lip portion, and a means for retaining at least one said nipple located at an end of each said stem portion opposite said adapter flange.

9. The nipple toy according to claim 8 wherein said elongated stem portion, extending from each said lip portion, and said means for retaining at least one said nipple located at the end of each said stem portion spans the internal diameter of said spherical body.

10. A method of assembling a nipple toy comprising:

a) providing a hollow spherical body comprising upper and lower hemispherical members each member having means for mechanically locking said hemispherical members one to the other, each of said members further having a plurality of semicircular openings;

i) a plurality of hollow pliable nipples; and ii) a plurality of nipple retainers;

b) inserting a portion of said nipple retainers into said nipples;

c) positioning said nipples with said retainers into exposed portions of said semicircular openings in said lower hemispherical member in a manner wherein a portion of said nipple and said retainer is inside said hemispherical member with remainder of said nipple extending outwardly from said hemispherical member; and d) mating said upper hemispherical member with said lower hemispherical member in an interlocking relationship.

11. The method of assembling the nipple toy according to claim, 10 further comprising the step of replacing one of said nipples with a handle assembly by utilizing one of said openings in said spherical body for attaching said handle assembly.

* * * * *